US011141977B2

(12) United States Patent
Sawada et al.

(10) Patent No.: US 11,141,977 B2
(45) Date of Patent: Oct. 12, 2021

(54) INKJET PRINTER AND NONVOLATILE MEMORY STORING COMPUTER PROGRAM

(71) Applicant: Roland DG Corporation, Hamamatsu (JP)

(72) Inventors: Teppei Sawada, Hamamatsu (JP); Akifumi Arai, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 16/779,714

(22) Filed: Feb. 3, 2020

(65) Prior Publication Data

US 2020/0254767 A1 Aug. 13, 2020

(30) Foreign Application Priority Data

Feb. 13, 2019 (JP) ..... JP2019-023517

(51) Int. Cl.
*B41J 2/165* (2006.01)
*B41J 2/17* (2006.01)
*B41J 2/21* (2006.01)

(52) U.S. Cl.
CPC ..... *B41J 2/16526* (2013.01); *B41J 2/16535* (2013.01); *B41J 2/1721* (2013.01); *B41J 2/2117* (2013.01); *B41J 2002/16573* (2013.01)

(58) Field of Classification Search
CPC ..... B41J 2/16526
See application file for complete search history.

(56) References Cited

U.S. PATENT DOCUMENTS 5,710,581 A * 1/1998 Barton ..... B41J 2/1652 347/19
6,042,214 A * 3/2000 Minowa ..... B41J 2/1652 347/23
6,527,361 B1 * 3/2003 Gotoh ..... B41J 2/1652 347/24
6,796,633 B1 * 9/2004 Kawamata ..... B41J 2/16523 347/23
2004/0252158 A1 * 12/2004 Shindo ..... B41J 2/16526 347/35

(Continued)

FOREIGN PATENT DOCUMENTS

JP 2018-1672 A 1/2018

*Primary Examiner* — Shelby L Fidler
(74) *Attorney, Agent, or Firm* — Keating & Bennett, LLP

(57) ABSTRACT

An inkjet printer includes a first ink head, an ink collector, and an intermittent flushing controller. The first ink head includes a first sub-head that includes a first nozzle to discharge first ink, a second sub-head that includes a second nozzle to discharge second ink different from the first ink, and a nozzle surface provided with the first nozzle and the second nozzle. The ink collector collects the ink discharged from the first ink head. The intermittent flushing controller performs an intermittent flushing operation for at least the first sub-head. The intermittent flushing operation involves repeating a first operation and a second operation for a predetermined number of iterations. The first operation involves discharging the first ink into the ink collector from the first nozzle a predetermined number of times. The second operation involves being on standby for a predetermined time without discharging the first ink from the first nozzle.

11 Claims, 5 Drawing Sheets

(56) References Cited

U.S. PATENT DOCUMENTS

2005/0212851 A1* 9/2005 Akase ..... B41J 2/16526
347/40
2012/0320118 A1* 12/2012 Yokomaku ..... B41J 2/16526
347/11

* cited by examiner

INKJET PRINTER AND NONVOLATILE MEMORY STORING COMPUTER PROGRAM

CROSS REFERENCE TO RELATED APPLICATIONS

This application claims the benefit of priority to Japanese Patent Application No. 2019-023517 filed on Feb. 13, 2019. The entire contents of this application are hereby incorporated herein by reference.

BACKGROUND OF THE INVENTION

1. Field of the Invention

The present invention relates to inkjet printers and nonvolatile memories storing computer programs.

2. Description of the Related Art

Inkjet printers known in the related art include ink heads that include nozzle surfaces provided with nozzles to discharge ink. Such inkjet printers perform cleaning so as to enable the nozzles to stably discharge ink.

JP 2018-001672 A, for example, discloses an inkjet printer that includes an ink head, a cap, a suction pump, and a wiper. The ink head includes a nozzle surface provided with nozzles. The cap covers the nozzle surface. The suction pump is connected to the cap. The wiper wipes the nozzle surface. The inkjet printer disclosed in JP 2018-001672 A carries out cleaning that involves performing a sucking operation, a wiping operation, and a successive flushing operation in this order. The sucking operation involves driving the suction pump, with the cap attached to the nozzle surface of the ink head. The wiping operation involves wiping the nozzle surface with a wiper. The successive flushing operation involves discharging a predetermined amount of ink from the nozzles in succession. During the successive flushing operation, each nozzle discharges ink, for example, 10,000 times or more (e.g., 10,000 to 50,000 times) in succession.

The ink heads of the inkjet printers known in the related art may include a first sub-head to discharge first ink, and a second sub-head to discharge second ink different in color from the first ink. The first and second sub-heads may be integral with each other. The nozzle surfaces of the first and second sub-heads may be adjacent to each other. Such an ink head may cause the second ink to enter into the first sub-head during cleaning, resulting in mixture of the first ink and the second ink (hereinafter referred to as "color mixture") in the first sub-head.

Research conducted by the inventors of preferred embodiments of the present invention suggests that once the second ink has entered into the first sub-head as mentioned above, the successive flushing operation known in the related art has difficulty in eliminating the color mixture. This may unfortunately make the color mixture conspicuous when printing is effected using the first sub-head. If the first ink and the second ink greatly differ, in particular, in lightness, the ink higher in lightness makes the color mixture very conspicuous.

SUMMARY OF THE INVENTION

Accordingly, preferred embodiments of the present invention provide inkjet printers that each includes an ink head including a plurality of sub-heads integral with each other so as to discharge ink of a plurality of colors, and prevents or reduces color mixture during printing more effectively than before.

An inkjet printer according to a preferred embodiment of the present invention includes a first ink head, an ink collector, and an intermittent flushing controller. The first ink head includes a first sub-head, a second sub-head, and a nozzle surface. The first sub-head includes a first nozzle to discharge first ink. The second sub-head includes a second nozzle to discharge second ink different from the first ink. The nozzle surface is provided with the first nozzle and the second nozzle. The ink collector collects the ink discharged from the first ink head. The intermittent flushing controller performs an intermittent flushing operation for at least the first sub-head. The intermittent flushing operation involves repeating a first operation and a second operation for a predetermined number of iterations. The first operation involves discharging the first ink into the ink collector from the first nozzle a predetermined number of times. The second operation involves being on standby for a predetermined time without discharging the first ink from the first nozzle.

The intermittent flushing controller of the inkjet printer is able to perform the intermittent flushing operation for the first nozzle that discharges the first ink. The intermittent flushing operation involves repeating the first operation (which includes a flushing operation) and the second operation (which includes a standby operation). During the standby operation after the flushing operation included in the intermittent flushing operation, the second ink remaining in the first sub-head may mix with the first ink. The intermittent flushing operation may provide pulsations to the ink in the first sub-head so as to produce convection of the ink. The intermittent flushing operation thus makes it likely that the second ink in the first sub-head (in particular, the second ink having entered into a minute portion in the first sub-head) will be discharged during the next flushing operation. Accordingly, the intermittent flushing operation is able to eliminate or reduce color mixture more effectively than successive flushing operations known in the related art. Consequently, the present preferred embodiment prevents or reduces color mixture during printing.

Various preferred embodiments of the present invention provide inkjet printers that each includes an ink head including a plurality of sub-heads integral with each other so as to discharge ink of a plurality of colors, and prevents or reduces color mixture during printing more effectively than before.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Inkjet printers according to preferred embodiments of the present invention will be described below with reference to the drawings. The preferred embodiments described below are naturally not intended to limit the present invention in any way. Components or elements having the same functions are identified by the same reference signs, and description thereof will be omitted or simplified when redundant.

As used herein, the term "inkjet printer" refers to any of various printers that use inkjet printing methods known in the related art, such as continuous methods (e.g., a binary deflection method and a continuous deflection method) and various on-demand methods (e.g., a thermal method and a piezoelectric method). As used herein, the term "printer" includes, but is not limited to, a "two-dimensional printer" to print a two-dimensional image and a "three-dimensional printer (or three-dimensional printing apparatus)" to print a three-dimensional object.

Figure 1:
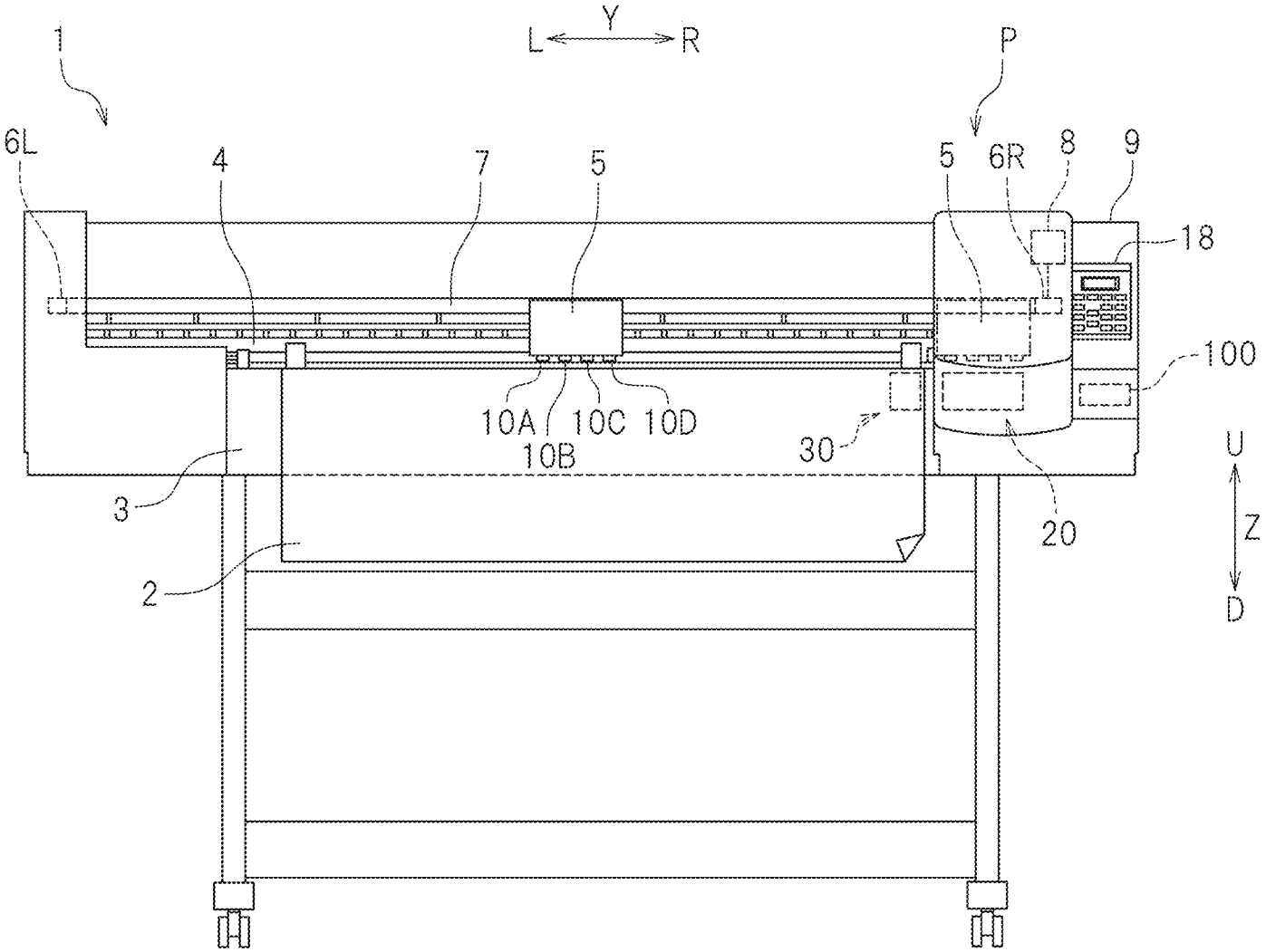
FIG. 1 is a front view of an inkjet printer according to a preferred embodiment of the present invention.

FIG. 1 is a front view of an inkjet printer 1 (hereinafter referred to as a "printer 1") according to a preferred embodiment of the present invention. The printer 1 is a two-dimensional printer. As used herein, the terms "right", "left", "up", and "down" respectively refer to right, left, up, and down with respect to a user (i.e., the user of the printer 1) facing the front of the printer 1. The term "forward" refers to a direction away from the rear of the printer 1 and toward the user. The term "rearward" refers to a direction away from the user and toward the rear of the printer 1. The reference signs F, Rr, R, L, U, and D in the drawings respectively represent front, rear, right, left, up, and down. The reference sign X in the drawings represents a front-rear direction. The reference sign Y in the drawings represents a right-left direction. The reference sign Z in the drawings represents an up-down direction. These directions are defined merely for the sake of convenience of description and do not limit in any way how the printer 1 may be installed.

The printer 1 is a large business-use printer to effect printing on a large-size recording medium 2. The recording medium 2 may be in a rolled form. In the present preferred embodiment, the recording medium 2 is "rolled paper". The recording medium 2, however, is not limited to a rolled form. A material for the recording medium 2 is not limited to any particular material. The recording medium 2 may be any medium other than paper (such as plain paper and inkjet printing paper). Examples of the recording medium 2 include: a sheet or film made of resin, such as polyvinyl chloride (PVC) or polyester; a plate made of any of various materials, such as aluminum, iron, wood, and glass; and a fabric, such as a woven fabric or a nonwoven fabric. The recording medium 2 may be any other suitable medium.

As illustrated in FIG. 1, the printer 1 includes a platen 3, a guide rail 4, a carriage 5, a casing 9, ink heads 10A to 10D, an ink collecting unit 20, a wiping unit 30, and a controller 100. The ink heads 10A to 10D may hereinafter be referred to as "ink heads 10" when no distinction is made therebetween. The platen 3 is provided in the casing 9. The platen 3 extends in the right-left direction Y. The platen 3 is disposed below the guide rail 4. The recording medium 2 is placed on the platen 3. The platen 3 supports the recording medium 2 during printing. The guide rail 4 is disposed above the platen 3. The guide rail 4 is provided in the casing 9. The guide rail 4 extends in the right-left direction Y. The carriage 5 is in slidable engagement with the guide rail 4. The carriage 5 holds the ink heads 10A to 10D.

The printer 1 includes a pulley 6R, a pulley 6L, an endless belt 7, and a carriage motor 8. The pulley 6R is disposed rightward of the guide rail 4. The pulley 6L is disposed leftward of the guide rail 4. The belt 7 is wound around the pulley 6R and the pulley 6L. The carriage motor 8 is connected to the pulley 6R. The carriage 5 is secured to the belt 7. The carriage motor 8 is electrically connected to the controller 100 and thus controlled by the controller 100. Driving the carriage motor 8 rotates the pulley 6R, causing the belt 7 to run. The running of the belt 7 moves the carriage 5 in the right-left direction Y along the guide rail 4. The mechanism for moving the carriage 5, which has just been described, is given by way of example only. Any other suitable mechanism may be used to move the carriage 5.

Figure 2:
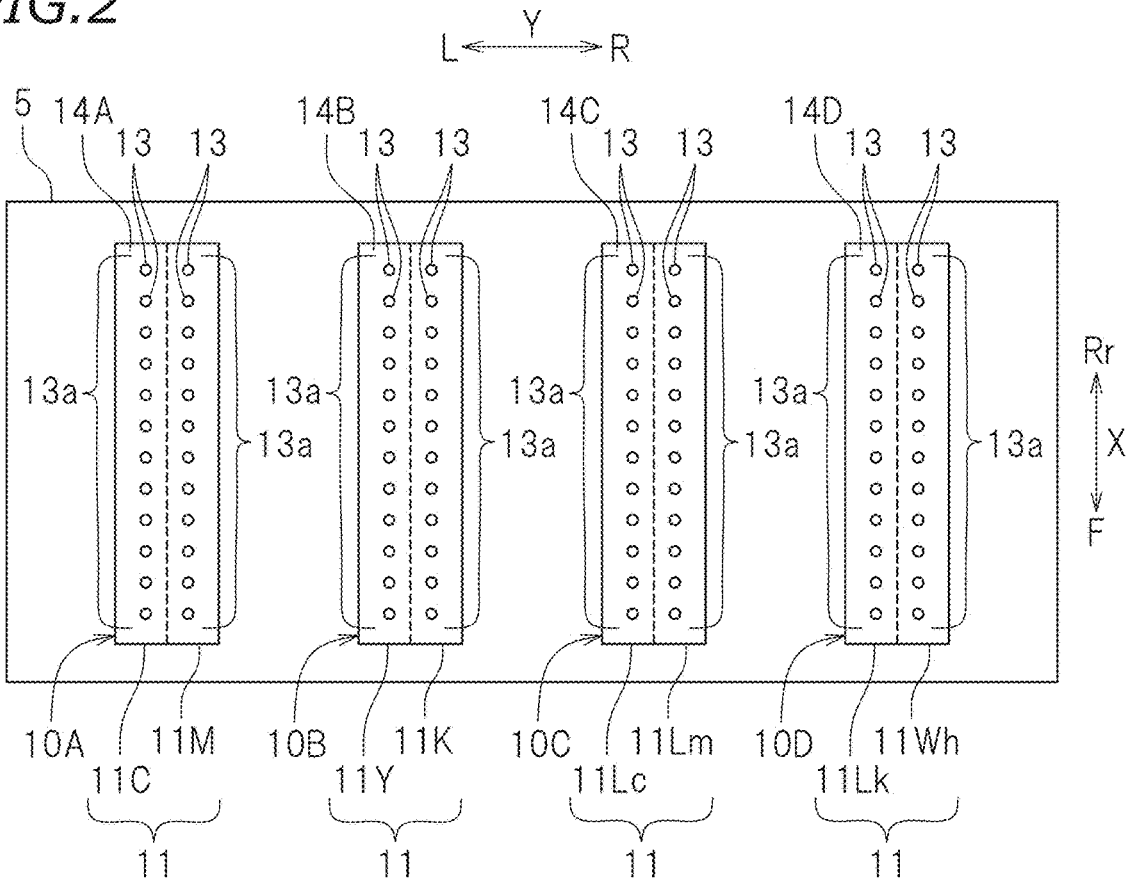
FIG. 2 is a bottom view of a carriage and ink heads.

FIG. 2 is a bottom view of the carriage 5 and the ink heads 10A to 10D. As illustrated in FIG. 2, the carriage 5 is fitted with four ink heads (i.e., the ink head 10A, the ink head 10B, the ink head 10C, and the ink head 10D), for example. The four ink heads 10A to 10D are arranged side by side in the right-left direction Y. The ink heads 10A to 10D each include two sub-heads 11. The two sub-heads 11 of each of the ink heads 10A to 10D are arranged side by side in the right-left direction Y. The number of sub-heads 11 included in the printer 1 is eight in total, for example. The ink heads 10A to 10D each include the two sub-heads 11 integral with each other. The ink heads 10A to 10D are each able to discharge up to two types of ink (i.e., ink of two colors). The number of ink heads 10 and the number of sub-heads 11 in the present preferred embodiment are given by way of example only and are not limiting. The printer 1 may include any other suitable number of ink heads 10. Each ink head 10 may include any other suitable number of sub-heads 11.

The ink heads 10A to 10D respectively include nozzle plates 14A to 14D each provided with a plurality of nozzles 13. In the present preferred embodiment, each of the nozzle plates 14A to 14D is an example of a nozzle surface. In the present preferred embodiment, the nozzle plate 14A is provided for the two sub-heads 11 of the ink head 10A adjacent to each other in the right-left direction Y. The nozzle plate 14B is provided for the two sub-heads 11 of the ink head 10B adjacent to each other in the right-left direction Y. The nozzle plate 14C is provided for the two sub-heads 11 of the ink head 10C adjacent to each other in the right-left direction Y. The nozzle plate 14D is provided for the two sub-heads 11 of the ink head 10D adjacent to each other in the right-left direction Y. The nozzle plates 14A to 14D may be provided in any other suitable manner. In one example, a nozzle plate may be provided for each of the sub-heads 11. In the present preferred embodiment, the nozzles 13 of each sub-head 11 are aligned in a nozzle row 13*a* in the front-rear direction X. The nozzles 13 of each sub-head 11 may be arranged in any other suitable manner. The nozzles 13 of each sub-head 11 may be disposed, for example, in a staggered arrangement. Each sub-head 11 may include two nozzle rows, for example.

Figure 3:
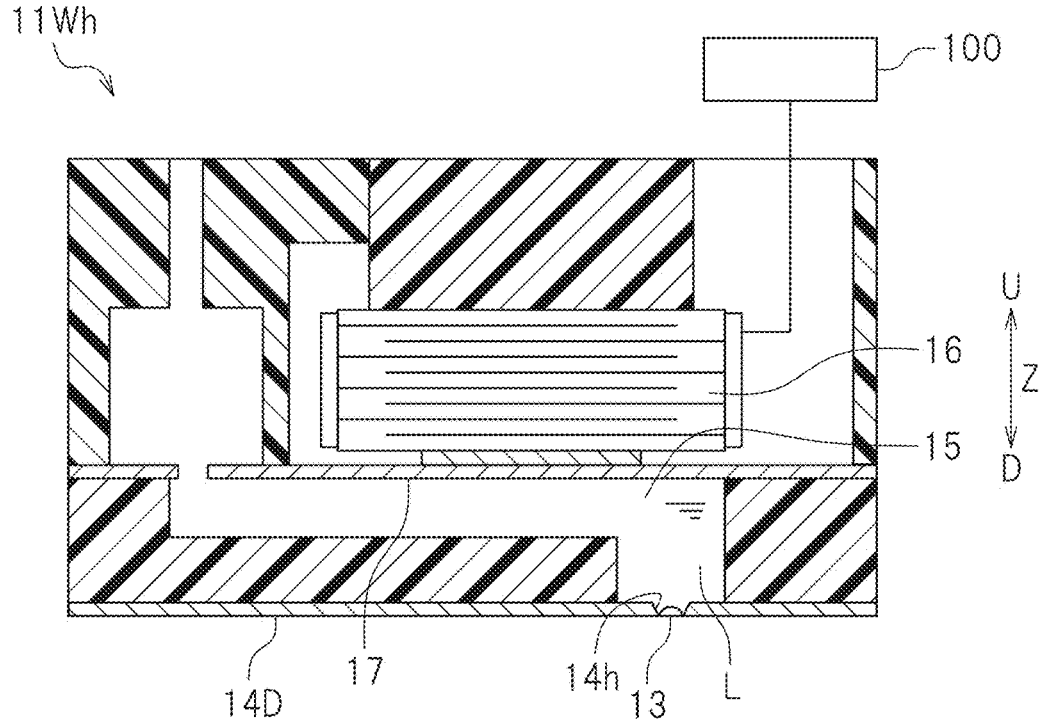
FIG. 3 is a vertical cross-sectional view of a portion of a sub-head.

FIG. 3 is a vertical cross-sectional view of a portion of a sub-head 11Wh. Specifically, FIG. 3 is a vertical cross-sectional view of the sub-head 11Wh taken along a plane passing through the center of one of the nozzles 13. As illustrated in FIG. 3, the sub-head 11Wh includes a pressure chamber 15 and an actuator 16. The pressure chamber 15 is filled with ink L (which is white ink in FIG. 3). The actuator 16 pressurizes the ink L in the pressure chamber 15. A portion of the sub-head 11Wh that defines the pressure chamber 15 (e.g., the lower portion of the sub-head 11Wh in FIG. 3) is fitted with the nozzle plate 14D. A nozzle hole 14*h* is defined in the nozzle plate 14D. The nozzle hole 14*h* passes through the nozzle plate 14D in the up-down direction Z. The nozzle hole 14*h* has a conical shape. The nozzle hole 14*h* has a predetermined cone angle. The nozzle hole 14*h* tapers toward the nozzle 13. In other words, the nozzle hole 14*h* tapers downward in FIG. 3. The pressure chamber 15 is in communication with the nozzle 13 through the nozzle hole 14*h*.

The actuator 16 includes a piezoelectric element. The actuator 16 is connected to a diagram 17. The diagram 17 partitions off a portion of the pressure chamber 15. The actuator is electrically connected to the controller 100 and thus controlled by the controller 100. The controller 100 transmits a signal of a predetermined driving waveform to the actuator 16. Application of a voltage to the actuator 16 by the controller 100 distorts the actuator 16. The distortion of the actuator 16 bends the diagram 17 so as to pressurize or depressurize the ink L inside the pressure chamber 15. Pressurizing the ink L inside the pressure chamber 15 discharges the ink L from the nozzle 13. Although the sub-head 11Wh has been described by way of example, the other sub-heads 11 are similar in structure to the sub-head 11Wh.

The pressure chambers 15 of the sub-heads 11 are filled with the ink L of different types. Various types of ink that have been used in the related field are usable as the ink L. Examples of the ink L may include solvent pigment ink, water-soluble pigment ink, water-soluble dye ink, and ultraviolet-curable pigment ink that is cured upon being exposed to ultraviolet light. Examples of the ink L may further include process color ink to form, for example, CMYK images, and pretreatment primer ink to form a primary coating or undercoating for an image. The ink L may be gloss ink (i.e., transparent ink) or metallic ink that gives a shine to the surface of an image.

In the present preferred embodiment, the pressure chambers 15 of the eight sub-heads 11 are each filled with one of cyan ink (C), magenta ink (M), yellow ink (Y), black ink (K), light cyan ink (Lc), light magenta ink (Lm), light black ink (Lk), and white ink (Wh). In the present preferred embodiment, white ink is an example of first ink, and light black ink is an example of second ink.

As illustrated in FIG. 2, the ink head 10A according to the present preferred embodiment includes a sub-head 11C and a sub-head 11M that are integral with each other. The sub-head 11C discharges cyan ink. The sub-head 11M discharges magenta ink. The ink head 10B includes a sub-head 11Y and a sub-head 11K that are integral with each other. The sub-head 11Y discharges yellow ink. The sub-head 11K discharges black ink. The ink head 10C includes a sub-head 11Lc and a sub-head 11Lm that are integral with each other. The sub-head 11Lc discharges light cyan ink. The sub-head 11Lm discharges light magenta ink. The ink head 10D includes a sub-head 11Lk and the sub-head 11Wh that are integral with each other. The sub-head 11Lk discharges light black ink. The sub-head 11Wh discharges white ink. A combination of the sub-heads 11 integrated into each ink head 10 is not limited to any particular combination. In an alternative example, the pressure chambers 15 of two or more of the eight sub-heads 11 may be filled with the ink L of the same type.

The two types of ink to be discharged from each of the ink heads 10A to 10D may have a difference in lightness. In the present preferred embodiment, the difference in lightness between the two types of ink to be discharged from the ink head 10D is greater than the difference in lightness between the two types of ink to be discharged from each of the ink heads 10A, 10B, and 10C. As used herein, the term "lightness" refers to lightness specified in JIS Z 8721: 1993. The difference in lightness between the ink to be discharged from the sub-head 11Wh of the ink head 10D and the ink to be discharged from the sub-head 11Lk of the ink head 10D is, for example, about 5.0 or more, about 7.0 or more, or about 8.0 or more. In the present preferred embodiment, the ink head 10D is an example of a first ink head, and each of the ink heads 10A to 10C is an example of a second ink head. The sub-head 11Wh is an example of a first sub-head, and the sub-head 11Lk is an example of a second sub-head.

The ink collecting unit 20 collects ink (e.g., waste ink) discharged from the ink head(s) 10 during, for example, a pre-printing flushing operation, a cleaning operation, and an intermittent flushing operation (which will be described below). As illustrated in FIG. 1, the ink collecting unit 20 is disposed at a cleaning position P adjacent to the right end of the casing 9. As indicated by the associated imaginary line in FIG. 1, the carriage 5 is moved to the cleaning position P by the controller 100 when the pre-printing flushing operation, the cleaning operation, or the intermittent flushing operation is performed. At the cleaning position P, the ink collecting unit 20 is located directly below the carriage 5.

Figure 4:
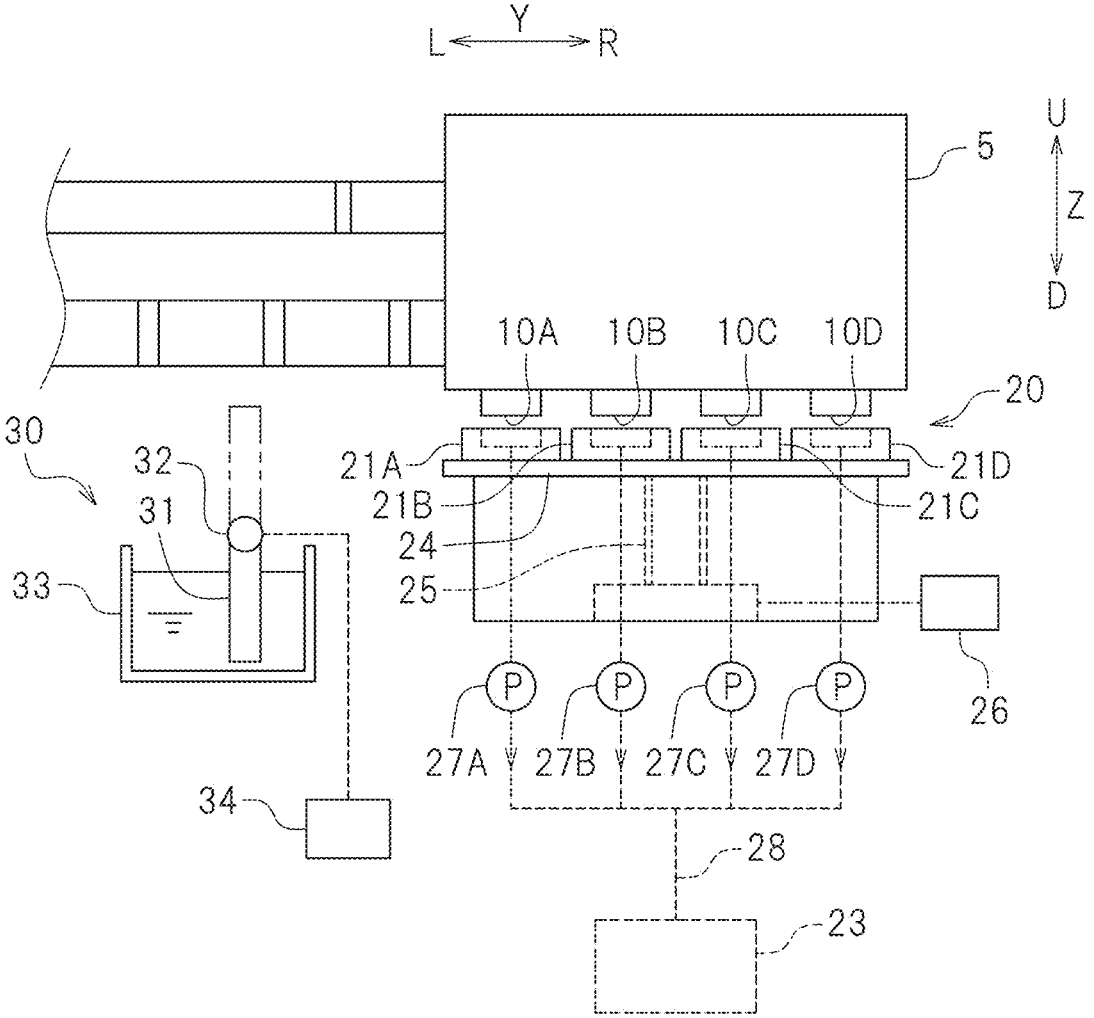
FIG. 4 is a front view of the carriage, an ink collecting unit, and a wiping unit.

FIG. 4 is a front view of the carriage 5, the ink collecting unit 20, and the wiping unit 30. As illustrated in FIG. 4, the ink collecting unit 20 includes caps 21A to 21D (which may hereinafter be referred to as "caps 21" when no distinction is made therebetween), a support 24, a ball screw 25, a motor 26, and suction pumps 27A to 27D. The support 24 supports the caps 21A to 21D. The ball screw 25 is in engagement with the support 24. The motor 26 is connected to the ball screw 25. The suction pumps 27A to 27D are respectively connected to the caps 21A to 21D. The motor 26 is electrically connected to the controller 100 and thus controlled by the controller 100. Rotation of the ball screw 25 caused by the motor 26 raises or lowers the support 24. The raising or lowering of the support 24 moves the caps 21A to 21D close to or away from the ink heads 10A to 10D. In the present preferred embodiment, the motor 26 is an example of an ink collector conveyor to move the caps 21A to 21D close to or away from the nozzle plates 14A to 14D.

The caps 21A to 21D are secured to the same support 24. The number of caps 21 is equal to the number of ink heads 10. In the present preferred embodiment, the number of caps 21 is four, for example. The caps 21A to 21D are respectively detachably attached to the ink heads 10A to 10D. With the carriage 5 at the cleaning position P, the caps 21A to 21D are respectively located directly below the ink heads 10A to 10D. In a plan view, the caps 21A to 21D respectively conform in shape to the nozzle plates 14A to 14D. In the present preferred embodiment, the caps 21A to 21D each have a bottomed box shape with an opening defined in its upper portion. The caps 21A to 21D that are respectively attached to the ink heads 10A to 10D cover the surrounding areas of the nozzles 13 of the ink heads 10. In the present preferred embodiment, each of the caps 21A to 21D is an example of an ink collector.

The caps 21A to 21D are in communication with a waste fluid tank 23 through a waste fluid passage 28. The waste fluid passage 28 is, for example, a tube. The suction pumps 27A to 27D are each connected to a location somewhere along the waste fluid passage 28. The suction pumps 27A to 27D respectively suck the ink L from the nozzles 13 of the ink heads 10A to 10D. The suction pumps 27A to 27D deliver the ink L, remaining in the caps 21A to 21D, to the waste fluid tank 23. The suction pumps 27A to 27D are electrically connected to the controller 100 and thus controlled by the controller 100. With the caps 21A to 21D respectively attached to the ink heads 10A to 10D, driving the suction pumps 27A to 27D sucks out the ink L from the nozzles 13 of the ink heads 10A to 10D such that the ink L is discharged into the caps 21A to 21D. The ink L discharged into the caps 21 is then collected into the waste fluid tank 23 through the waste fluid passage 28.

As illustrated in FIG. 4, the wiping unit 30 includes a wiper 31, a rotary shaft 32, a washing tank 33, and a rotary motor 34. The rotary shaft 32 supports an end of the wiper 31. The washing tank 33 is disposed below the rotary shaft 32. The rotary motor 34 is connected to the rotary shaft 32. The wiper 31 is a flexible member to wipe the nozzle plates 14A to 14D. The wiper 31 has a flat plate shape extending in the front-rear direction X and the up-down direction Z. The length of the wiper 31 measured in the front-rear direction X is longer than the length of each of the ink heads 10A to 10D measured in the front-rear direction X. The wiper 31 is connected to the rotary shaft 32. The rotary shaft 32 extends in the front-rear direction X. The rotary motor rotates the rotary shaft 32. The rotary motor 34 is electrically connected to the controller 100 and thus controlled by the controller 100. The rotation of the rotary shaft 32 caused by the rotary motor 34 rotates the wiper 31 around the rotary shaft 32.

When the wiper 31 assumes a washing position at which an end of the wiper 31 away from the rotary shaft 32 faces downward as indicated by the associated solid line in FIG. 4, the lower end of the wiper 31 is immersed in a cleaning liquid in the washing tank 33. When the wiper 31 assumes a wiping position at which the end of the wiper 31 away from the rotary shaft 32 faces upward as indicated by the associated imaginary line in FIG. 4, the upper end of the wiper 31 is located slightly above the nozzle plates 14A to 14D. Moving the carriage 5 in the right-left direction Y in this state brings the wiper 31 into contact with the nozzle plates 14A to 14D. The surfaces of the nozzle plates 14A to 14D are thus wiped with the wiper 31. In the present preferred embodiment, the rotary motor 34 is an example of a wiper conveyor to bring the wiper 31 into contact with the nozzle plates 14A to 14D.

The controller 100 controls various operations to be performed by the printer 1. As illustrated in FIG. 1, the controller 100 according to the present preferred embodiment is disposed inside the casing 9. In the present preferred embodiment, the controller 100 is a computer dedicated to the printer 1. The controller 100 is, for example, a microcomputer. Alternatively, the controller 100 may be, for example, a general-purpose personal computer disposed outside the casing 9. The controller 100 is communicably connected to the carriage motor 8, the actuators 16 of the ink heads 10, the motor 26 and the suction pumps 27A to 27D of the ink collecting unit 20, and the rotary motor 34 of the wiping unit 30. The controller 100 is thus able to control the carriage motor 8, the actuators 16, the motor 26, the suction pumps 27A to 27D, and the rotary motor 34.

The controller 100 is not limited to any particular hardware configuration. The controller 100 includes, for example, an interface (I/F), a central processing unit (CPU), a read-only memory (ROM), a random-access memory (RAM), and a storage (such as a memory). The I/F receives print data and other data. The CPU executes a command included in a control program. The ROM stores the program to be executed by the CPU. The RAM is used as a working area where the program is to be expanded. The storage device stores the program and various data.

Figure 5:
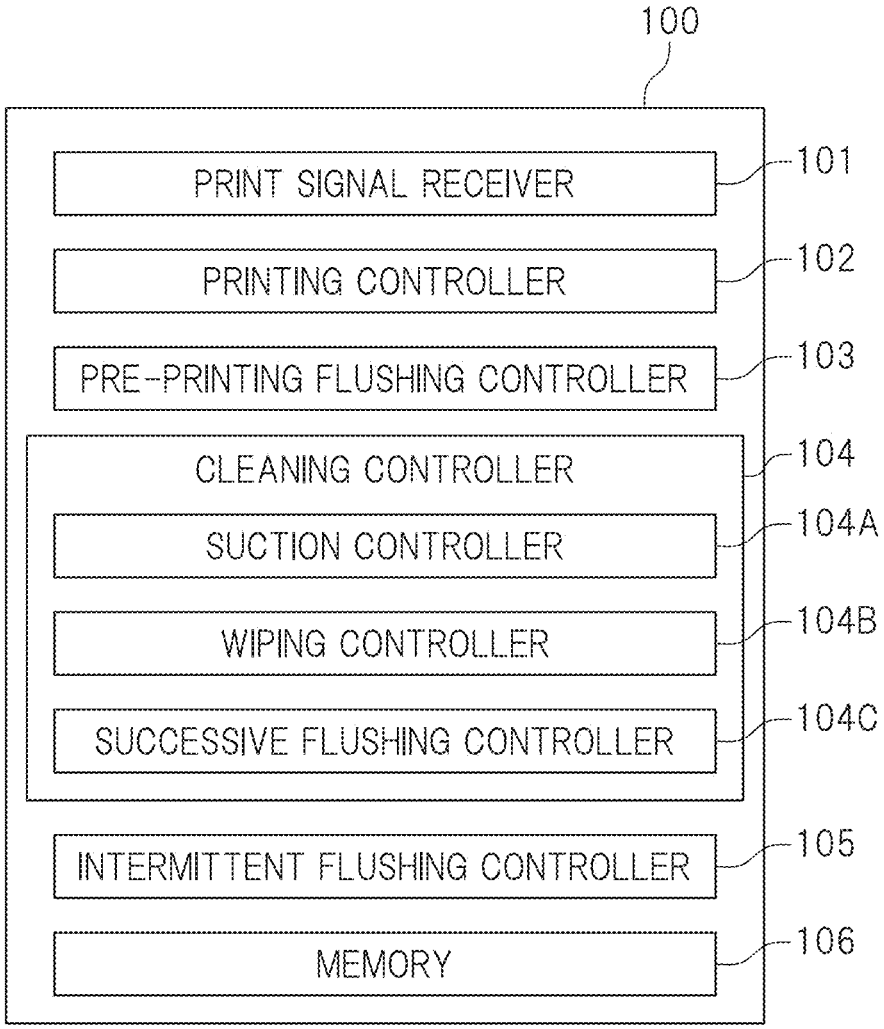
FIG. 5 is a functional block diagram of a controller.

FIG. 5 is a functional block diagram of the controller 100. The controller 100 includes a print signal receiver 101, a printing controller 102, a pre-printing flushing controller 103, a cleaning controller 104, an intermittent flushing controller 105, and a memory 106. The cleaning controller 104 includes a suction controller 104A, a wiping controller 104B, and a successive flushing controller 104C. The functions of the components of the controller 100 just mentioned may be implemented by software or hardware. In one example, the functions of the components of the controller 100 just mentioned may be performed by processor(s) or may be incorporated into circuit(s).

The print signal receiver 101 receives, from an external device (not illustrated), a signal that provides an instruction for printing (which will hereinafter be referred to as a "print instruction signal") and print data. In accordance with the print data, the printing controller 102 performs a printing operation for the recording medium 2. The printing controller 102 drives the carriage motor 8 so as to move the carriage 5 in the right-left direction Y. The printing controller 102 drives the actuators 16 of the ink heads 10A to 10D such that the ink L is discharged from the nozzles 13.

Upon reception of the print instruction signal by the print signal receiver 101, the pre-printing flushing controller 103 performs a flushing operation (which is typically a successive flushing operation). The pre-printing flushing controller 103 typically first drives the motor 26 so as to attach the caps 21A to 21D to the nozzle plates 14A to 14D, respectively. With the caps 21A to 21D respectively attached to the ink heads 10A to 10D, the pre-printing flushing controller 103 then drives the actuators 16 of the ink heads 10A to 10D so as to perform a successive flushing operation that involves simultaneously discharging the ink L into the caps 21A to 21D from the nozzles 13. During the successive flushing operation, the ink L is discharged from the nozzles 13 of the ink heads 10A to 10D a predetermined number of times in succession. The number of times the ink L is to be discharged in succession before printing is preliminarily stored in the memory 106. The number of times the ink L is to be discharged in succession before printing is, for example, between 2,000 and 8,000 inclusive. Upon finishing the successive flushing operation, the pre-printing flushing controller 103 may drive the motor 26 so as to detach the caps 21A to 21D from the nozzle plates 14A to 14D, respectively, and move the caps 21A to 21D away from the nozzle plates 14A to 14D, respectively.

The cleaning controller 104 performs cleaning for the ink heads 10A to 10D. As used herein, the term "cleaning" refers to any of various operations to prevent clogging of the nozzles 13 and unclog the nozzles 13. The term "cleaning" includes a sucking operation to suck the ink L inside the pressure chambers 15 through the nozzles 13, a wiping operation to wipe the nozzle plates 14A to 14D with the wiper 31, and a successive flushing operation to discharge the ink L from the nozzles 13 in succession. As indicated by the associated imaginary lines in FIG. 1, the cleaning controller 104 drives the carriage motor 8 so as to move the carriage 5 to the cleaning position P.

The suction controller 104A performs, for example, a sucking operation for the ink heads 10A to 10D. The timings of the sucking operation to be performed by the suction controller 104A include, for example, at least one of the following timings: before the print signal receiver 101 receives the print instruction signal; and during the printing operation performed by the printing controller 102. The suction controller 104A first drives the motor 26 so as to attach the caps 21A to 21D to the nozzle plates 14A to 14D, respectively. With the caps 21A to 21D respectively attached to the ink heads 10A to 10D, the suction controller 104A then drives the suction pumps 27A to 27D so as to perform the sucking operation to suck the ink L from the nozzles of the ink heads 10A to 10D. The suction controller 104A drives the suction pumps 27A to 27D so as to perform an idle sucking operation to deliver the ink L, remaining in the caps 21A to 21D, to the waste fluid tank 23.

The wiping controller 104B performs a wiping operation for the ink heads 10A to 10D. The timings of the wiping operation to be performed by the wiping controller 104B include, for example, at least one of the following timings: before the print signal receiver 101 receives the print instruction signal; and during the printing operation performed by the printing controller 102. The wiping controller 104B performs the wiping operation, for example, after the suction controller 104A has performed the sucking operation. With the caps 21A to 21D respectively detached from the ink heads 10A to 10D, the wiping controller 104B drives the rotary motor 34 of the wiping unit 30 so as to move the wiper 31 to the wiping position. With the wiper 31 located at the wiping position, the wiping controller 104B drives the carriage motor 8 so as to move the carriage 5 leftward and/or rightward. The wiping controller 104B thus performs the wiping operation that involves wiping the surfaces of the nozzle plates 14A to 14D. Performing the wiping operation wipes off ink and/or soil adhering to the nozzle plates 14A to 14D. Performing the wiping operation also adjusts the meniscus of nozzles 13.

The successive flushing controller 104C performs a successive flushing operation for the ink heads 10A to 10D. The timings of the successive flushing operation to be performed by the successive flushing controller 104C include, for example, at least one of the following timings: before the print signal receiver 101 receives the print instruction signal; and during the printing operation performed by the printing controller 102. The successive flushing controller 104C performs the successive flushing operation, for example, following the sucking operation performed by the suction controller 104A and/or following the wiping operation performed by the wiping controller 104B. The successive flushing controller 104C typically first drives the motor 26 so as to attach the caps 21A to 21D to the nozzle plates 14A to 14D, respectively. With the caps 21A to 21D respectively attached to the ink heads 10A to 10D, the successive flushing controller 104C then drives the actuators 16 of the ink heads 10A to 10D so as to perform the successive flushing operation that involves simultaneously discharging the ink L into the caps 21A to 21D from the nozzles 13. During the successive flushing operation, the ink L is discharged from the nozzles 13 of the ink heads 10A to 10D a predetermined number of times in succession. The number of times the ink L is to be discharged in succession during cleaning is preliminarily stored in the memory 106. The number of times the ink L is to be discharged in succession during cleaning is typically greater than the number of times the ink L is to be discharged in succession before printing. The number of times the ink L is to be discharged in succession during cleaning is, for example, between 10,000 and 100,000 inclusive.

The intermittent flushing controller 105 performs an intermittent flushing operation for at least the sub-head 11Wh of the ink head 10D that discharges two types of the ink L greatly different in lightness. When the ink head 10D is presumably in a predetermined color mixture state, the intermittent flushing controller 105 performs the intermittent flushing operation to reduce color mixture. The intermittent flushing controller 105 performs the intermittent flushing operation, for example, during or after the cleaning operation. The intermittent flushing controller 105 performs the intermittent flushing operation, for example, following the sucking operation performed by the suction controller 104A or following the wiping operation performed by the wiping controller 104B. The intermittent flushing controller 105 performs the intermittent flushing operation, for example, immediately following the wiping operation performed by the wiping controller 104B. The intermittent flushing controller 105 may perform no intermittent flushing operation for the sub-heads 11 other than the sub-head 11Wh. In other words, the intermittent flushing controller 105 may perform no intermittent flushing operation for the sub-heads 11C, 11M, 11Y, 11K, 11Lc, 11Lm, and 11Lk.

The intermittent flushing controller 105 typically first drives the motor 26 so as to move the caps 21A to 21D close to the nozzle plates 14A to 14D, respectively. In a typical example, with the cap 21D attached to the ink head 10D, the intermittent flushing controller 105 repeats a first operation and a second operation. The first operation involves performing a flushing operation. The second operation involves being on standby without performing any flushing operation. It is not limited but, the inventors consider the intermittent flushing operation as being effective in reducing color mixture, for example, for the reasons described below.

Figure 6A:
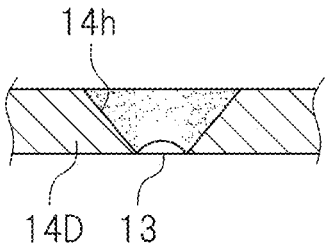
FIGS. 6A to 6E are each an enlarged view of a nozzle and a nozzle hole of the sub-head and an area adjacent thereto.

FIGS. 6A to 6E are schematic diagrams each illustrating the nozzle 13 and the nozzle hole 14*h* of the sub-head 11Wh and an area adjacent thereto. The black dots in FIGS. 6A to 6E indicate light black ink. Although not illustrated in FIGS. 6A to 6E, the nozzle hole 14*h* is in communication with the pressure chamber 15 filled with white ink as illustrated in FIG. 3. FIG. 6A illustrates the state of the nozzle hole 14*h* after cleaning. During, for example, the sucking operation, the white ink in the sub-head 11Wh and the light black ink in the sub-head 11Lk are discharged into the same cap 21D. This may mix up the two types of ink inside the cap 21D and bring the light black ink into contact with the nozzle 13 of the sub-head 11Wh. During the wiping operation, the light black ink in the sub-head 11Lk may flow along the wiper 31 and come into contact with the nozzle 13 of the sub-head 11Wh. This may cause the light black ink to enter into the sub-head 11Wh through the nozzle 13 as illustrated in FIG. 6A. The light black ink that has entered into the sub-head 11Wh will hereinafter be referred to as "mixed color ink". The mixed color ink, which has entered into the sub-head 11Wh through the nozzle 13, may move upward along the side of the nozzle hole 14*h* and penetrate into the pressure chamber 15.

Figure 6B:
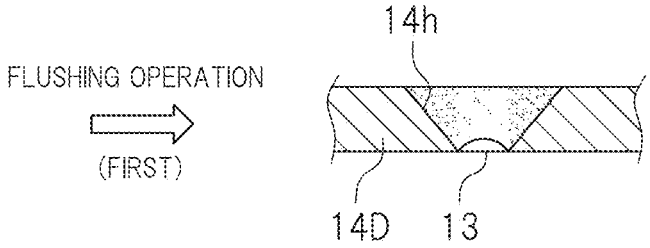

The present preferred embodiment thus first involves performing the first flushing operation (i.e., the first operation) to discharge the ink from the nozzle 13. During the flushing operation, the white ink is sequentially supplied to the pressure chamber 15. This produces a flow of ink toward the nozzle 13 in a region of the nozzle hole 14*h* directly above the nozzle 13 (i.e., a central region of the nozzle hole 14*h*). FIG. 6B illustrates the state of the nozzle hole 14*h* after the first flushing operation has been performed. As illustrated in FIG. 6B, the first flushing operation may suitably discharge the mixed color ink through the region of the nozzle hole 14*h* where the ink flows toward the nozzle 13. The light black ink, however, is still stagnant and remains, for example, in a region of the nozzle hole 14*h* where a flow of ink toward the nozzle 13 is weak (e.g., a conical shaped off-center region of the nozzle hole 14*h*).

Figure 6C:
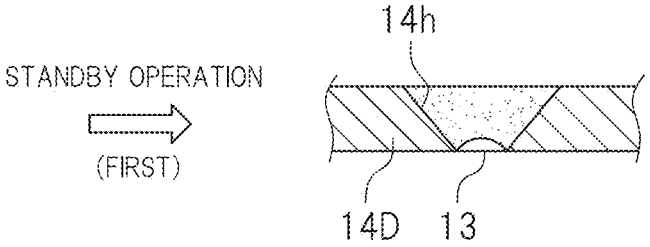

The present preferred embodiment then involves performing the first standby operation (i.e., the second operation). The standby operation involves being on standby without discharging the ink L from the nozzle 13. During the standby operation, no white ink is supplied to the pressure chamber 15. The standby operation stops the flow of ink toward the nozzle 13. This may produce a flow of ink into the pressure chamber 15 along the nozzle hole 14*h*. FIG. 6C illustrates the state of the nozzle hole 14*h* after the first standby operation has been performed. As illustrated in FIG. 6C, the first standby operation may cause the mixed color ink, remaining in the region of the nozzle hole 14*h* where the flow of ink is weak (e.g., the conical shaped off-center region of the nozzle hole 14*h*), to be diffused through the nozzle hole 14*h*, mixing the mixed color ink with the white ink.

Figure 6D:
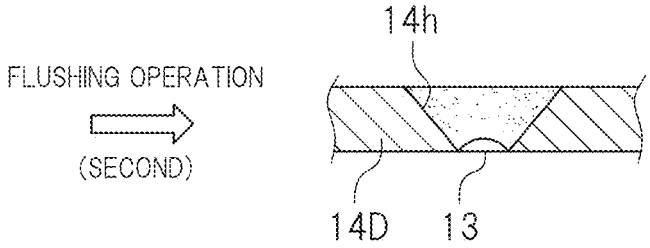
Figure 6E:
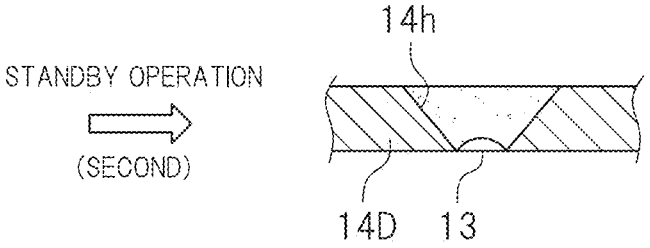

With the mixed color ink mixed with the white ink and diffused through the nozzle hole 14*h*, the present preferred embodiment involves performing the second flushing operation (i.e., the first operation) to discharge the ink from the nozzle 13. FIG. 6D illustrates the state of the nozzle hole 14*h* after the second flushing operation has been performed. As illustrated in FIG. 6D, the second flushing operation may suitably discharge the mixed color ink remaining in the region of the nozzle hole 14*h* where the flow of ink is weak. The present preferred embodiment then involves performing the second standby operation (i.e., the second operation). FIG. 6E illustrates the state of the nozzle hole 14*h* after the second standby operation has been performed. Performing the flushing operation at least twice, with the standby operation performed in between, may provide pulsations to the ink in the sub-head 11Wh. This may produce convection of ink in the pressure chamber 15. As illustrated in FIG. 6E, the second standby operation re-mixes the white ink with the remaining mixed color ink, diffusing the mixed color ink through the nozzle hole 14*h*. Repeating the flushing operation and the standby operation alternately in this manner will presumably efficiently eliminate or reduce color mixture.

In the present preferred embodiment, the intermittent flushing controller 105 repeats the first operation and the second operation for a predetermined number of iterations. The first operation involves activating the actuator 16 of the ink head 10D for a first predetermined time so as to discharge the ink L into the cap 21D from the nozzles 13 a first predetermined number of times. The first operation is followed by the second operation. The second operation involves deactivating the actuator 16 of the ink head 10D for a second predetermined time. In the present preferred embodiment, the first predetermined number of times is an example of a predetermined number of times the ink is to be discharged in the first operation, and the second predetermined time is an example of a predetermined time during which the intermittent flushing controller 105 is put on standby in the second operation. The first predetermined number of times, the first predetermined time, the second predetermined time, and the predetermined number of iterations are preliminarily stored in the memory 106. The intermittent flushing controller 105 may drive the suction pump 27D during the first operation or during the first and second operations such that the ink remaining in the cap 21D is delivered to the waste fluid tank 23.

The first predetermined number of times may be any number of times. The first predetermined number of times for each first operation is, for example, between 8,000 and 10,000 inclusive. The first predetermined number of times for each first operation may be equal to or greater than the number of times the ink L is to be discharged in succession during the flushing operation performed by the pre-printing flushing controller 103. The first predetermined number of times for each first operation may be equal to or smaller than the number of times the ink L is to be discharged in succession during the successive flushing operation performed by the successive flushing controller 104C. The first predetermined time for each first operation is a time during which the ink L is to be discharged the first predetermined number of times. The first predetermined time for each first operation may be equal to or longer than the time during which the ink L is to be discharged in succession during the flushing operation performed by the pre-printing flushing controller 103. The first predetermined time for each first operation may be equal to or shorter than the time during which the ink L is to be discharged in succession during the successive flushing operation performed by the successive flushing controller 104C.

The second predetermined time for each second operation is, for example, a time during which the mixed color ink is diffused through the nozzle hole 14*h* and enters a predetermined diffused state. The second predetermined time for each second operation may be any period of time. The second predetermined time for each second operation is typically shorter than the first predetermined time for each first operation. From the viewpoint of reducing the time required for the intermittent flushing operation, the second predetermined time for each second operation may be, for example, five seconds or less. In one example, the second predetermined time for each second operation may be one second or less. From the viewpoint of promoting diffusion of the mixed color ink, the second predetermined time for each second operation may be, for example, about 0.1 seconds or more. In one example, the second predetermined time for each second operation may be about 0.5 seconds or more. The sum of the first and second predetermined times may be within about one minute. The sum of the first and second predetermined times may typically be within about 30 seconds. The sum of the first and second predetermined times may be, for example, between about 1 second and about 10 seconds inclusive.

The predetermined number of iterations may be two or more. From the viewpoint of providing strong pulsations to the ink in the sub-head 11Wh, the predetermined number of iterations may typically be three or more or may be, for example, five or more. From the viewpoint of reducing the time required for the intermittent flushing operation, the predetermined number of iterations may be about 50 or less or may be, for example, 20 or less. The predetermined number of iterations may be set such that the total consumption of ink during the intermittent flushing operation, for example, is equal to or smaller than the consumption of ink during the successive flushing operation performed by the successive flushing controller 104C.

The printer 1 according to the present preferred embodiment may execute the intermittent flushing operation, for example, before the print signal receiver 101 receives the print instruction signal in the course of the cleaning operation. The printer 1 may execute, for example, a procedure including the steps of: a) performing the sucking operation; b) performing the wiping operation; c) performing the intermittent flushing operation; d) performing the successive flushing operation; e) receiving the print instruction signal; and f) performing the printing operation. The printer 1 may perform the steps a), b), c), d), e), and f) in this order. The printer 1 may perform any other operation at any time during the procedure. At least one of the steps a), b), and d), for example, may be skipped.

As described above, the printer 1 according to the present preferred embodiment performs the intermittent flushing operation (which includes intervals between the flushing operations) for at least the sub-head 11Wh. The intermittent flushing operation is thus able to discharge the light black ink (i.e., the mixed color ink) from the nozzles 13 more efficiently than successive flushing operations known in the related art. Consequently, the intermittent flushing operation is able to prevent or reduce color mixture during printing more effectively than successive flushing operations known in the related art. Research conducted by the inventors suggests that the intermittent flushing operation is able to more efficiently eliminate or reduce color mixture with a relatively smaller amount of ink than successive flushing operations known in the related art.

The printer 1 according to the present preferred embodiment includes the motor 26, the suction pump 27D, and the suction controller 104A. The motor 26 moves the cap 21D close to or away from the nozzle plate 14D. The suction pump 27D is connected to the cap 21D. The suction controller 104A performs the sucking operation that involves attaching the cap 21D to the nozzle plate 14D and driving the suction pump 27D so as to suck the ink through the nozzles 13. The intermittent flushing controller 105 performs the intermittent flushing operation after the sucking operation. During the sucking operation, two types of ink mix inside the cap 21D, making it likely that color mixture will occur. To cope with this, the present preferred embodiment involves performing the intermittent flushing operation after the sucking operation. The techniques disclosed herein are thus particularly effective in preventing or reducing color mixture.

The printer 1 according to the present preferred embodiment includes the wiper 31, the rotary motor 34, and the wiping controller 104B. The rotary motor 34 moves the wiper 31 into contact with the nozzle plate 14D. The wiping controller 104B performs the wiping operation that involves moving the wiper 31 into contact with the nozzle plate 14D so as to wipe the nozzle plate 14D with the wiper 31. The intermittent flushing controller 105 performs the intermittent flushing operation following the wiping operation (e.g., immediately after the wiping operation). During the wiping operation, foreign matter (such as ink) adhering to the nozzle plate 14D is removed, but color mixture may occur owing to the ink flowing along the wiper 31. To cope with this, the present preferred embodiment involves performing the intermittent flushing operation following the wiping operation, with no foreign matter (such as ink) adhering to the nozzle plate 14D. This makes it unlikely that color mixture will occur again. Consequently, the techniques disclosed herein are particularly effective in preventing or reducing color mixture.

The sub-head 11Wh of the printer 1 according to the present preferred embodiment includes the pressure chamber 15 and the actuator 16. The pressure chamber 15 is filled with the ink L (e.g., white ink). The pressure chamber 15 is in communication with the nozzles 13 through the nozzle holes 14*h*. The actuator 16 pressurizes the ink L in the pressure chamber 15 so as to discharge the ink L from the nozzles 13. The intermittent flushing controller 105 activates the actuator 16 during the first operation and deactivates the actuator 16 during the second operation. The actuator 16 has high response speed. The use of the actuator 16 thus makes it possible to perform the intermittent flushing operation with high accuracy.

The second predetermined time set for the printer 1 according to the present preferred embodiment is a time during which the light black ink (e.g., the mixed color ink) that has penetrated into the nozzle holes 14*h* from the nozzles 13 is diffused through the nozzle holes 14*h* and enters the predetermined diffused state. The second predetermined time is, for example, between about 0.1 seconds and about 1 second inclusive. This more successfully promotes the diffusion of the mixed color ink and reduces the time required for the intermittent flushing operation.

The predetermined number of iterations set for the printer 1 according to the present preferred embodiment is three or more. This provides strong pulsations to the ink in the sub-head 11Wh, increasing convection of the ink in the sub-head 11Wh. Consequently, the present preferred embodiment more advantageously achieves the effects of the techniques disclosed herein.

The printer 1 according to the present preferred embodiment includes the ink head 10A, the ink head 10B, and the ink head 10C. The ink head 10A includes the sub-head 11C that includes the nozzles 13 to discharge cyan ink, and the sub-head 11M that includes the nozzles 13 to discharge magenta ink. The ink head 10B includes the sub-head 11Y that includes the nozzles 13 to discharge yellow ink, and the sub-head 11K that includes the nozzles 13 to discharge black ink. The ink head 10C includes the sub-head 11Lc that includes the nozzles 13 to discharge light cyan ink, and the sub-head 11Lm that includes the nozzles 13 to discharge light magenta ink. The intermittent flushing controller 105 performs no intermittent flushing operation for at least one of the sub-heads 11C, 11M, 11Y, 11K, 11Lc, 11Lm, and 11Lk. For example, suppose that the sub-head(s) 11 is/are not in a predetermined color mixture state or color mixture is inconspicuous on the recording medium 2 although the sub-head(s) 11 is/are in the predetermined color mixture state. In this case, performing the intermittent flushing operation for all the sub-heads 11 will waste the ink L. Such waste of the ink L is avoidable by performing the intermittent flushing operation selectively for only the sub-head(s) 11 that require(s) reducing color mixture.

The printer 1 according to the present preferred embodiment includes the successive flushing controller 104C to perform the successive flushing operation that involves discharging the ink L from the nozzles 13 in succession. The successive flushing controller 104C performs the successive flushing operation for all the sub-heads 11 after the intermittent flushing operation has been performed for the sub-head 11Wh. Thus, if no intermittent flushing operation is performed for one or more of the sub-heads 11, the states of all the sub-heads 11 would be adjusted such that the nozzles 13 are uniform in meniscus.

The first predetermined number of times set for the printer 1 according to the present preferred embodiment may be smaller than the number of times the ink L is to be discharged in succession during the successive flushing operation performed by the successive flushing controller 104C. The intermittent flushing operation is thus able to prevent or reduce color mixture with a smaller amount of ink than the successive flushing operation. Consequently, the present preferred embodiment reduces the consumption of ink.

The printer 1 according to the present preferred embodiment includes the print signal receiver 101 and the pre-printing flushing controller 103. The print signal receiver 101 receives a signal that provides an instruction for printing. Upon reception of the signal by the print signal receiver 101, the pre-printing flushing controller 103 performs the flushing operation that involves discharging the ink L from the nozzles 13. The first predetermined number of times set for the printer 1 according to the present preferred embodiment is greater than the number of times the ink L is to be discharged during the flushing operation performed by the pre-printing flushing controller 103. This more successfully prevents or reduces occurrence of color mixture. The present preferred embodiment thus more advantageously achieves the effects of the techniques disclosed herein.

The techniques disclosed herein provide a nonvolatile memory storing a computer program that causes a computer to function as the controller 100 of the printer 1. The computer program causes a computer to operate as at least the intermittent flushing controller 105. The computer program causes, for example, a computer to operate as the print signal receiver 101, the printing controller 102, the pre-printing flushing controller 103, the cleaning controller 104, and the intermittent flushing controller 105.

The computer program may be stored, for example, in a nonvolatile memory. In other words, the techniques disclosed herein provide a computer-readable nonvolatile memory storing the computer program. Examples of the nonvolatile memory include: semiconductor storages, such as a read-only memory (ROM) and a memory card; optical storages, such as a digital versatile disc (DVD), a magneto-optical (MO) disc, a minidisc (MD), a compact disc (CD), and a Blu-ray disc (BD); and magnetic storages, such as a magnetic tape and a flexible disk. The computer program may be transmitted to a cloud server through any of the storages just mentioned or a network (such as the Internet).

Although the preferred embodiments of the present invention has been described thus far, the preferred embodiments described above are only illustrative. Preferred embodiments of the present invention may be embodied in various other forms. Preferred embodiments of the present invention may be practiced based on the disclosure of this specification and technical common knowledge in the related field. The techniques described in the claims include various changes and modifications made to the preferred embodiments illustrated above. Any or some of the technical features of the foregoing preferred embodiments may be replaced with any or some of the technical features of variations described below. Any or some of the technical features of the variations described below may be added to the technical features of the foregoing preferred embodiments. Any or some of the technical features of the foregoing preferred embodiments may be appropriately combined with any or some of the technical features of the variations described below. Unless described as being essential, some of the technical features of the foregoing preferred embodiments and the variations thereof described below may be optional.

The printer 1 according to the present preferred embodiment performs the intermittent flushing operation, for example, for only the sub-head 11Wh that discharges white ink. White ink is higher in lightness than other types of ink. In the present preferred embodiment, the sub-head 11Wh that discharges white ink and the sub-head 11Lk that discharges light black ink are included in the same ink head 10D. This makes it likely that color mixture will be particularly conspicuous on the recording medium 2. To cope with this, the foregoing preferred embodiment involves performing the intermittent flushing operation for the sub-head 11Wh. Consequently, the techniques disclosed herein are particularly effective in preventing or reducing color mixture. The intermittent flushing operation, however, may be performed for any other sub-head(s) 11. The intermittent flushing operation may be performed for the sub-head(s) 11 that discharge(s) any type of ink. The intermittent flushing operation may naturally be performed for, for example, the sub-head 11Y that discharges yellow ink, in addition to or instead of the sub-head 11Wh. When the intermittent flushing operation is performed for two or more of the sub-heads 11, the first predetermined number of times, the first predetermined time, the second predetermined time, and the predetermined number of iterations may be stored in the memory 106 for each type of the ink L.

The first predetermined number of times for each first operation and the first predetermined time for each first operation do not necessarily have to be constant during the intermittent flushing operation. The first predetermined number of times may vary for each first operation. The first predetermined number of times for the initial first operation, for example, may be different from the first predetermined number of times for the subsequent first operations. The first predetermined time may vary for each first operation. The first predetermined time for the initial first operation, for example, may be different from the first predetermined time for the subsequent first operations. In one example, the first predetermined number of times may be set such that a difference between the first predetermined number of times for the initial first operation and the first predetermined number of times for the n-th first operation (where n is a natural number that satisfies $n \geq 2$) falls within a predetermined range. When the difference is expressed as a percentage, the predetermined range is, for example, about 10% or less. The second predetermined time for each second operation does not necessarily have to be constant during the intermittent flushing operation. The second predetermined time may vary for each second operation. The second predetermined time for the initial second operation, for example, may be different from the second predetermined time for the subsequent second operations. The number of iterations for the first operation and the number of iterations for the second operation do not necessarily have to be the same. At least one of the first predetermined number of times, the first predetermined time, the second predetermined time, and the predetermined number of iterations may be freely changed by, for example, the user of the printer 1.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet printer comprising:

a first ink head including:

a first sub-head that includes a first nozzle to discharge first ink;

a second sub-head that includes a second nozzle to discharge second ink different from the first ink; and a nozzle surface provided with the first nozzle and the second nozzle;

a second ink head including:

a third sub-head that includes a third nozzle to discharge third ink; and a fourth sub-head that includes a fourth nozzle to discharge fourth ink;

an ink collector to collect the ink discharged from the first ink head;

an intermittent flushing controller to perform an intermittent flushing operation for at least the first sub-head, the intermittent flushing operation involving repeating a first operation and a second operation for a predetermined number of iterations, the first operation involving discharging the first ink into the ink collector from the first nozzle a predetermined number of times, the second operation involving being on standby for a predetermined time without discharging the first ink from the first nozzle; and a successive flushing controller to perform a successive flushing operation that involves discharging the first ink, the second ink, the third ink, and the fourth ink from the first nozzle, the second nozzle, the third nozzle, and the fourth nozzle, respectively, in succession, wherein the intermittent flushing controller does not perform the intermittent flushing operation for at least one of the second sub-head, the third sub-head, and the fourth sub-head, and the successive flushing controller performs the successive flushing operation for all of the first, second, third, and fourth sub-heads after the intermittent flushing controller has performed the intermittent flushing operation for the first sub-head.

2. The inkjet printer according to claim 1, further comprising:

an ink collector conveyor to move the ink collector close to or away from the nozzle surface;

a suction pump connected to the ink collector; and a suction controller to perform a sucking operation that involves attaching the ink collector to the nozzle surface and driving the suction pump so as to suck the ink through the first nozzle and the second nozzle; wherein the intermittent flushing controller performs the intermittent flushing operation after the sucking operation.

3. The inkjet printer according to claim 1, further comprising:

a wiper;

a wiper conveyor to move the wiper into contact with the nozzle surface; and a wiping controller to perform a wiping operation that involves moving the wiper into contact with the nozzle surface and wiping the nozzle surface with the wiper; wherein the intermittent flushing controller performs the intermittent flushing operation following the wiping operation.

4. The inkjet printer according to claim 1, wherein the first sub-head further includes:

a nozzle hole;

a pressure chamber filled with the first ink, the pressure chamber being in communication with the first nozzle through the nozzle hole; and an actuator to pressurize the first ink in the pressure chamber so as to discharge the first ink from the first nozzle; and the intermittent flushing controller activates the actuator during the first operation and deactivates the actuator during the second operation.

5. The inkjet printer according to claim 4, wherein the predetermined time is a time during which the second ink that may have penetrated into the nozzle hole from the first nozzle is diffused through the nozzle hole and enters a predetermined diffused state during a wiping operation to move a wiper into contact with the nozzle surface and wiping the nozzle surface with the wiper or during a sucking operation to attach the ink collector to the nozzle surface and drive a suction pump to suck the ink through the first nozzle and the second nozzle.

6. The inkjet printer according to claim 1, wherein the predetermined time is between about 0.1 seconds and about 1 second inclusive.

7. The inkjet printer according to claim 1, wherein the predetermined number of iterations is three or more.

8. The inkjet printer according to claim 1, wherein, the predetermined number of times is smaller than the number of times the first ink is to be discharged in succession during the successive flushing operation performed by the successive flushing controller.

9. The inkjet printer according to claim 1, further comprising:

a print signal receiver to receive a signal that provides an instruction to print; and a pre-printing flushing controller to perform, upon reception of the signal by the print signal receiver, a flushing operation that involves discharging the first ink from the first nozzle, wherein the predetermined number of times is greater than the number of times the first ink is to be discharged during the flushing operation performed by the pre-printing flushing controller.

10. The inkjet printer according to claim 1, wherein the first ink is white ink.

11. A nonvolatile memory storing a computer program that causes a computer to operate as the intermittent flushing controller of the inkjet printer according to claim 1.

* * * * *